US005853304A

United States Patent [19]

Landreau et al.

[11] Patent Number: 5,853,304

[45] Date of Patent: Dec. 29, 1998

[54] TERMINAL BLOCK TYPE CONNECTION MODULE

[75] Inventors: Daniel Landreau, Champagne Au Mont D'Or; Etienne Briguet, Rillieux la Pape, both of France

[73] Assignee: Entrelec S.A., Villeurbanne, France

[21] Appl. No.: 623,120

[22] Filed: Mar. 28, 1996

[30] Foreign Application Priority Data

Mar. 29, 1995 [FR] France ..... 95 03707

[51] Int. Cl.[6] ..... H01R 9/26

[52] U.S. Cl. ..... 439/721; 439/716; 439/835

[58] Field of Search ..... 439/721, 723, 439/724, 439, 441, 796, 816, 835, 828, 716, 789

[56] References Cited

U.S. PATENT DOCUMENTS

| | | | |
|---|---|---|---|
| 4,940,431 | 7/1990 | Hennemann | 439/716 |
| 5,022,873 | 6/1991 | Kollmann | 439/716 |
| 5,071,356 | 12/1991 | Strate et al. | 439/721 |
| 5,334,054 | 8/1994 | Conrad et al. | 439/716 |
| 5,588,881 | 12/1996 | Eggert et al. | 439/716 |

FOREIGN PATENT DOCUMENTS

| | | |
|---|---|---|
| 2226761 | 11/1974 | France . |
| 2706482 | 8/1978 | Germany . |
| 42 01 219 C1 | 7/1993 | Germany . |
| 94 12 465.5 | 12/1994 | Germany . |
| WO 93/15535 | 8/1993 | WIPO . |

*Primary Examiner*—Gary F. Paumen

*Attorney, Agent, or Firm*—Sughrue, Mion, Zinn, Macpeak & Seas, PLLC

[57] ABSTRACT

The connection facility includes a link strip (3) equipped with at least one wire-connection part (2) formed by a spring blade looped back on itself, the strip being made of a rigid electrically conductive material, and including a main portion (30) that is plane in appearance, and that is edged by at least one support element (31) for supporting a looped connection part, onto which support element such a part is engaged, perforation first, via the perforation (21) with which it is provided at one of its two ends, while also pressing against the support element via its other end (23). The module includes a strip having a main portion which is positioned parallel to a large face forming the back of the housing.

12 Claims, 1 Drawing Sheet

TERMINAL BLOCK TYPE CONNECTION MODULE

BACKGROUND OF THE INVENTION

1. Field of the Invention

The invention relates to a connection facility for electrically conductive wires and including at least one conductive link strip equipped with at least one wire-connection part formed by a spring blade having a first end provided with a perforation for receiving a wire to be connected between a wire-abutment edge of the perforation and a second end of the spring blade as looped back on itself so as to make it possible, when no wire is present, for the second end to be resiliently pressed against the wire-abutment edge of the perforation into which the second end penetrates. The invention also relates to modules and in particular modules of the terminal block type equipped with at least one such connection facility.

2. Description of the Related Art

Connection facilities have long been known that are designed to make it possible for electrically conductive wires to be interconnected. For example, such interconnections may be performed by electrically conductive strips which co-operate with connection parts for wires which are connected to them. For example, such parts may be terminals of the type having screws, wire-clamping and contact slots, or wire-clamping and contact loops, as mentioned above.

An example of such a strip associated with screw terminals is given, in particular, in French Patent 2,226,761.

Connection parts of the type mentioned above have been in existence for a long time.

With respect to the above-mentioned loop terminals, it is possible to refer, by way of example, to German Patent 2,706,482 which discloses such a terminal implemented by means of a loop spring, in particular shown fixed to a terminal strip by means of a rivet.

SUMMARY OF THE INVENTION

For various reasons, and in particular because of technical and economic demands from users, manufacturers of such connection parts and of connection facilities in which such parts are implemented are obliged to attempt to improve them so as to make them more reliable, cheaper, and easier to implement and to use.

To this end, the present invention provides a connection facility for conductive wires, the connection facility including at least one conductive link strip composed of at least one common link element equipped with at least one wire-connection part formed by a spring blade having a first end provided with a perforation for receiving a wire to be connected between a wire-abutment edge of the perforation and a second end of the spring blade as looped back on itself so as to make it possible, when no wire is present, for the second end to be resiliently pressed against the wire-abutment edge of the perforation into which the second end penetrates.

According to the invention, the strip, made of a rigid electrically conductive material, includes at least one common link element that is plane in appearance, and that is edged by at least one support element for supporting a looped connection part, onto which support element such a part is engaged, perforation first, via the perforation with which it is provided at one of its two ends, while also pressing against the support element via its other end.

According to another characteristic of the invention, the strip is provided with a plurality of support elements which are disposed on the same side of the common element that interconnects them.

According to another characteristic of the invention, each of the support elements is constituted by a prong of rectangular section designed to co-operate with a rectangular perforation in a connection part so as to position said part.

According to another characteristic of the invention, each connection-part support element included in a strip is connected to the common link element, which carries it, via a portion firstly forming an abutment for the connection part, after such a part has been suitably engaged, and secondly serving to guide a wire to be connected towards the zone in which the perforation is located, into which perforation the wire is to penetrate in order to be connected.

According to another characteristic of the invention, the connection facility includes a strip having a link element carrying at least one offset "shunt" element which makes it possible to connect an external additional interconnection part for interconnection with another connection facility, the interconnection part being connected by straddling the shunt element, thereby avoiding having to reduce the dimensions of the link element where said interconnection part is connected.

According to another characteristic of the invention, the connection facility includes a strip having a link element carrying at least one offset shunt element making it possible to connect an external additional interconnection part for interconnection with another connection facility, the interconnection part being connected in a zone of the strip which is external to the common link element.

The present invention also provides a connection module, in particular of the terminal block type, including a housing containing at least one conductive-wire connection facility as described above.

According to a characteristic of the invention, a module includes a strip that is held stationary via a central device and/or via various portions of its periphery against at least one internal complementary bearing zone of the housing containing it, and the common link element which is plane in appearance, and which is included in the strip is positioned parallel to a large face of the housing.

According to another characteristic of the invention, a module includes a housing containing a strip having a common link element which is plane in appearance and which is positioned parallel to the large face forming the back of the housing, flush with an opening designed to be closed by an external element forming a partition parallel to the back.

According to yet another characteristic of the invention, a module includes a housing containing a strip carrying connection-part support elements which are disposed parallel to the large back face of the housing.

BRIEF DESCRIPTION OF THE DRAWINGS

The invention, its characteristics, and its advantages are described in more detail below with reference to the accompanying drawing, in which.

DETAILED DESCRIPTION OF THE PREFERRED EMBODIMENTS

Electrical equipment modules suitable for receiving one or more connection facilities of the invention can be implemented in different forms as a function of the specific needs of their users, as known.

Figure 1:
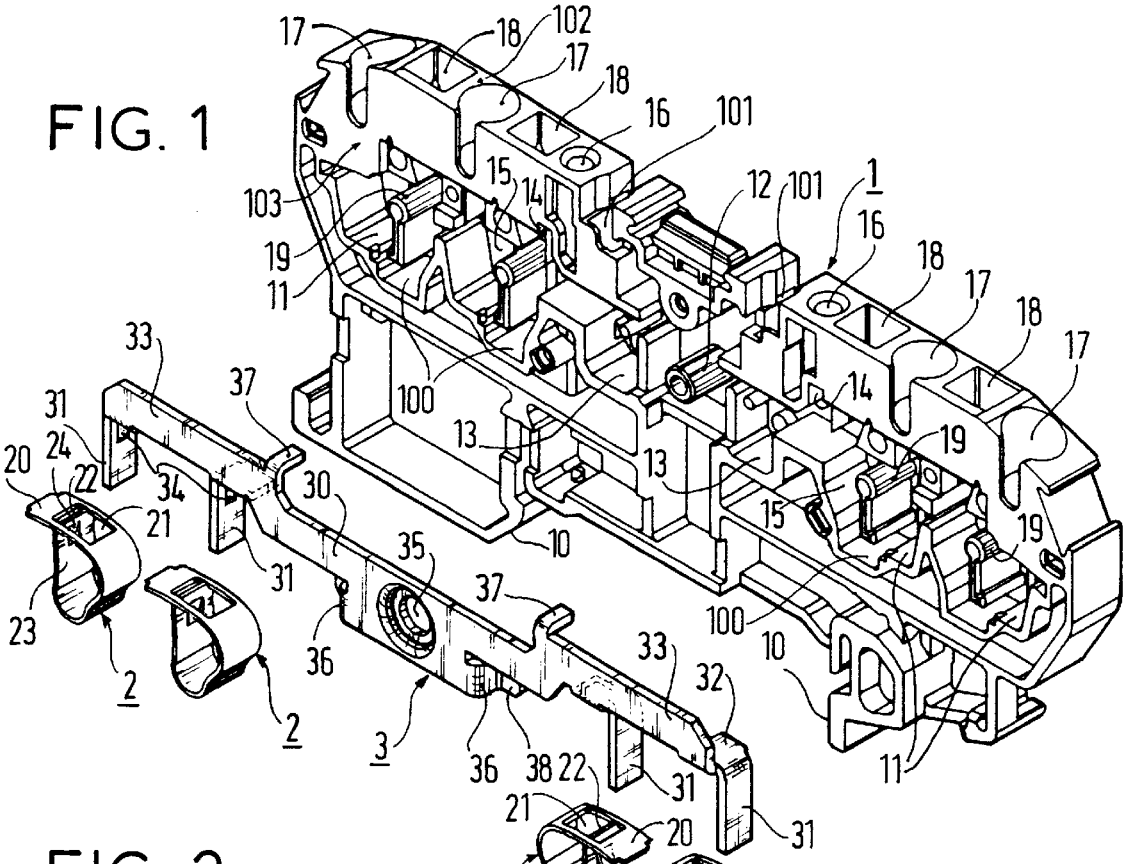
FIG. 1 is an exploded perspective view of an embodiment of an electrical equipment module, of the terminal block type in this example, containing a conductive-wire connection facility of the invention.
Figure 2:
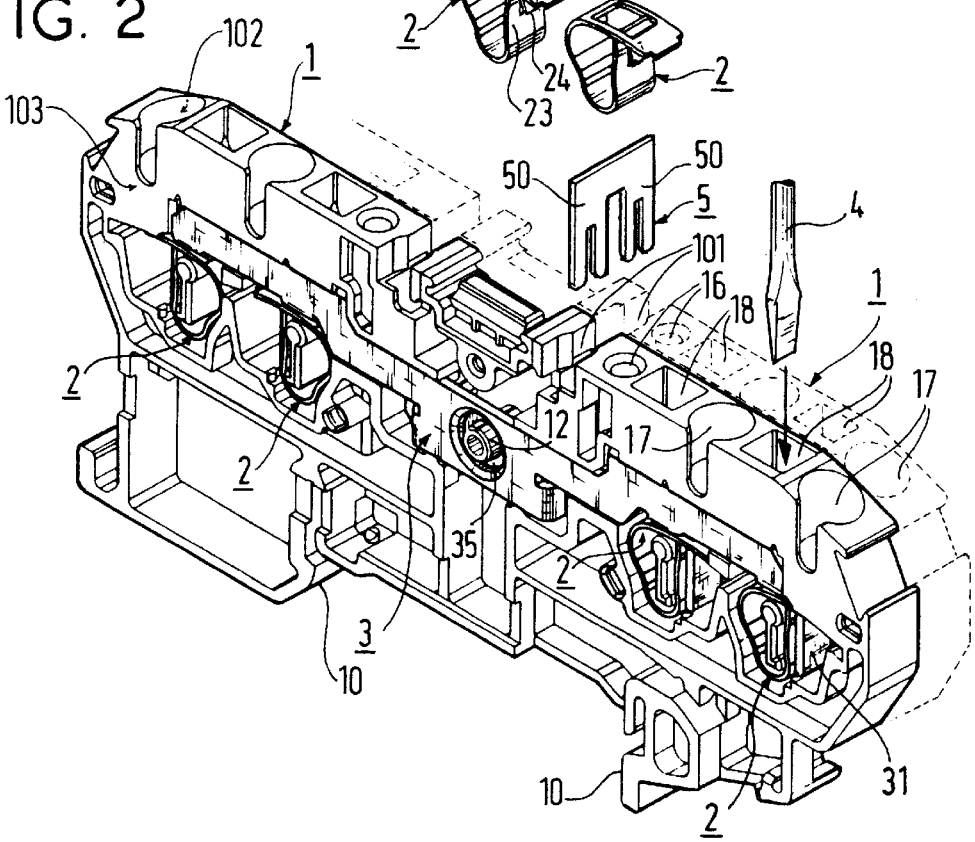
FIG. 2 is a perspective view of the module shown in FIG. 1, as assembled.

In the embodiment given by way of example and shown in FIGS. 1 and 2, such a module is assumed to be of the terminal block type, and it is thus composed of a housing 1 made of an insulating material and designed to receive at least one connection facility for electrically conductive wires.

In this example, the housing is assumed to be provided with a known device, that can conventionally be referred to as a "fixing bracket" enabling it to be fixed to a standardized-type support rail supporting other identical or compatible modules against or between which the module is to be placed.

In the embodiment described and shown, the housing 1 is flat in appearance and is approximately rectangular block shaped, and it includes a fixing bracket composed of elements designed in particular to co-operate in known manner, e.g. in pairs, to fix it to a standard rail, the housing then being designed to be disposed transversely relative to the rail that carries it.

In the embodiment described and shown, and using a known technique, the housing 1 is in the form of a small case that is elongate in appearance and that has a back in the form of a large face 102 suitable for acting as a side wall for separating the housing from another identical or compatible housing when the two housings are mounted side-by-side on a common support rail. In this example, the case formed by the housing 1 is assumed to be designed to be closed by an external partition-forming element which constitutes a second large side wall parallel to the side wall that forms the back. Recesses are specially formed in the housing on the back-forming large face 102 for receiving the various elements that are positioned thereon, and in particular the elements of the connection facility that the housing contains in the embodiment as shown. As indicated above, the external element designed to close the housing 1 may be a cover-forming plate that is fixed, e.g. by being snap-fastened, onto the housing 1, or else it may be the back of an adjoining identical or compatible other housing, which back is then organized so as to be complementary to the open portion of the housing against which it is to be pressed.

The connection facility described and shown comprises one or more (four in the example shown) wire-connection parts 2 and a part 3, referred to as a "strip" herein, making it possible to interconnect them.

As mentioned above, provision is made for at least one of the connection parts 2 to be of the looped type, it being understood that said at least one part may be associated either with identical or similar connection parts or with other types of connection parts, e.g. one of the types mentioned above.

In the embodiment described and shown, all four of the connection parts 2 are assumed to be identical and they are assumed to be intended to be mounted in pairs symmetrically about a transverse midplane passing through the housing, as shown in particular in FIG. 2.

Each connection part 2 described and shown is constituted conventionally by a spring blade, having a first end 20 provided with a perforation 21, of rectangular appearance in this example, which is designed to receive a wire to be connected (not shown) between a wire-abutment edge 22 of the perforation and a second end 23 of the spring blade as looped back on itself, so that, before the part is installed and when no wire is present, said second end is resiliently pressed against the abutment edge 22 of the perforation 21 into which said second end penetrates.

For interconnection purposes, a connection part 2 is electrically connected to a strip 3, preferably made of a rigid electrically conductive material, e.g. made by cutting out and folding a metal strip.

In this example, the appearance of the strip 3 is symmetrical about a transverse midplane which corresponds to that of the housing 1, when the connection facility including said strip is positioned in the housing. The strip includes a common link element 30 which is itself symmetrical about the above-defined transverse midplane, the link element being plane in appearance, and being designed to be placed parallel to the large face 102 serving as the back of the housing 1, preferably so that it is flush with the opening designed to be closed by an external partition-forming element.

Support elements 31 are carried by the common link element 30 for serving as individual supports for the connection parts 2. In this example, the support elements 31 are assumed to be made in the form of rectangular prongs by cutting out and folding the metal blank from which the link element common to them comes, and, more generally, from which all of the elements making up the strip come.

In the embodiment described and shown, the support elements 31 are assumed to be disposed symmetrically in pairs about the transverse midplane of the strip, and they are disposed transversely relative to the direction which defines the common link element 30 on the same side of which they are situated.

Each support element 31 is designed to co-operate with a connection part 2 which is engaged thereon. For this purpose, the support element 31 must be inserted via its free end (its end further form the common link element 30) from outside the connection part 2 into the rectangular perforation 21, between the end 23 and the wire-abutment edge 22 of the part. It must be inserted by being slid until the part comes into abutment via its end 20 (in which the perforation 21 is provided) against an abutment 32 provided where the support element 31 in question is connected to the common element 30 that carries it. The end 23 is then substantially pressed against the element 31, thereby ensuring that the connection part 2 is positioned accurately on the strip. In an embodiment, the end 23 of the connection part 2 and that portion of element 31 against which said end is pressed include complementary pieces of relief 24, 34 which lock together as soon as a connection part is positioned accurately, after it has been fully engaged onto an element 31 designed to receive it. For example, the complementary pieces of relief 24 and 34 may be constituted respectively by a notch and by a projection such as a punched-out portion, the notch and the projection having complementary shapes and being provided on the facing portions of the end 23 of the connection part and of the element 31 on which said part is engaged. Piece of relief 24 is situated on the end 23 which penetrates into the perforation 21 in the connection part and below the perforation. Piece of relief 34 is preferably situated in the vicinity of the abutment 32 via which the element 31 is connected to the portion 30 of the strip that includes it.

In an embodiment, the abutment 32 of a support element 31 is disposed so that the end 20 of the connection part as positioned on the element 31 abuts against it in the zone in which the rectangular perforation 21 in the part is situated, at least when no wire is connected.

The abutment 32 is thus substantially perpendicular to the element 31 that it connects, and the fold that is common to them participates in guiding a wire to be connected, so that the wire is guided towards the zone situated between the element 31 and the wire-abutment edge 22 of the perforation 21 provided in the connection part, rather than towards the zone that is not to be used and that is situated between the element 31 and the part end 23 that is pressed against said element.

In this example, the respective free ends of the support parts 31 are designed to abut against complementary bearing elements 11 of the housing 1 so as to participate in holding the strip 3 stationary in the housing and consequently the connection parts 2 carried by the strip. Other elements of the strip 3 also participate in holding it stationary, in particular at the link element 30 which abuts via various portions against bearing zones of the housing 1, which zones have complementary shapes (as suggested in FIG. 2). In the embodiment described and shown, the housing also includes a central centering stud 12, and two pairs of recesses 13 and 14 disposed around the centering stud 12.

The centering stud 12 is designed to be collared by a central portion of the strip 3 which is provided with a central device 35, a centering orifice in this example, which is complementary to the stud. In this example, the recesses 13 are designed to receive shunt elements 38 which are shown organized symmetrically about the transverse midplane of the strip 3 in the central portion thereof which is located in the vicinity of the fixing bracket 10, when the strip is suitably positioned in the housing 1. In this example, the elements 38 are assumed to be made in the form of tabs obtained by cutting out and folding. They are offset relative to the common link element 30 to which each of them is connected via an intermediate portion 36. In this example, they are made so that they are parallel to the plane defined by the common link element 30, and so that each of them is positioned facing an opening of a respective shunt duct 101 opening out to the outside of the housing in the wall furthest from the fixing bracket 10. In this example, each shunt duct 101 is rectangular in appearance, and it can receive a forked portion 50 of an additional interconnection part 5 for interconnection with an adjoining other connection facility, as shown in FIG. 2 for the two housings 1. Such a portion 50 of an interconnection part 5 is designed to be inserted into a shunt duct 101 and to straddle a shunt element 38 to which it is connected, e.g. by clamping. Insofar as the shunt element(s) 38 are offset relative to the common link element with which they are associated on a strip, they may have dimensions that correspond to the electrical interconnection needs, without that having a direct influence on the dimensions of the common link element, and, in particular, without it being necessary to reduce the dimensions of the common link element in the vicinity of the shunt elements, as is generally necessary with prior strips.

In a variant, it is also possible to effect at least one shunt at a shunt element implemented on the common link element 30 itself, which is then itself straddled by a portion of interconnection part, operating in analogous manner to the portion 50 of part 5.

Using two parts 5, each of which is inserted into a different shunt duct 101 of the same housing, constitutes one of the possibilities that enables the connection parts contained in the housing to be interconnected with those of two housings adjoining said housing.

In this example, the recesses 14 correspond to set-backs, each of which is provided at the edge of a respective one of the two recesses 15 designed to receive respective connection parts 2 in the housing 1 in the vicinity of the transverse midplane of the housing.

In this example, the recesses 14 are designed to receive contact elements 37 implemented in the form of tabs provided symmetrically about the transverse midplane of the strip 3 in the central portion thereof that is located further from the fixing bracket 10 when the strip is suitably positioned in the housing 1. In this example, the contact tabs 37 project relative to the strip on that side thereof which is designed to face towards the large side wall forming the back of the housing 1, like the shunt elements 38.

In this example, the recesses 14 communicate with the outside of the housing 1 via ducts 16 that can be used for passing a voltage probe and that open out in that wall of the housing that is furthest from the fixing bracket 10, like the ducts 17 and 18 necessary respectively for passing the wires to be connected to the connection parts 2, and for passing a tool blade, conventionally of the screwdriver blade type, such as 4, used to act on the connection parts 2 during connection.

The duct 17 and the duct 18 corresponding to the same connection part 2 open out on respective sides of a projection 19 projecting from the back of the housing 1 for abutting against the assembly formed by a support element 31 and by a connection part second end 23, pressed against the element and abutting against the projection 19 in a part-receiving cavity 100 in the housing 1. In the embodiment suggested, each connection part 2 is allocated an individual cavity 100 which is open facing the back of the housing so as to receive it, and which communicates with the adjacent cavity(ies) 100 via a passage in particular receiving the common link element 30 to which the various connection parts 2 contained in the housing 1 are connected in this example. The passage (not referenced) in which the common link element 30 is positioned is also open facing the back of the housing so that all of the elements included in the strip 3 can be installed in the housing 1 in a single insertion step.

As known, connecting a conductive wire to a connection part, such as 2, is possible after the abutment edge 22 of the part has been moved apart from the end 23 against which the edge bears when no wire is present. Such moving apart is obtained by compressing the loop forming the part, e.g. under the action of the end of a tool blade 4 inserted into the duct 18 opening out into the cavity 100 in which the part is located inside the housing 1. The end of the blade 4 is inserted behind the part between a wall of the cavity 100 and that curved portion of the loop formed by the part which is furthest from the projection 19 and from the element 31 against which projection and element said part is pressed via its end 23. By pushing on the blade 4 bearing against the loop, it is possible to compress the loop, thereby moving the abutment edge 22 apart from the element 31, and clearing the access to the perforation 21 in the part, which perforation is then in alignment with the wire-receiving duct 17. It is then possible to insert the end of wire into the perforation 21 after said wire has been pushed into the corresponding duct. On releasing the pressure exerted on the part by the end of blade 4, the abutment edge 22 is resiliently urged back towards the element 31, thereby clamping and electrically connecting the conductive wire inserted between said edge and said element.

Naturally, the connection facility of the invention may be implemented in configurations that are different from the one described and shown, and in particular, it is possible to provide a different number of connection parts per strip, and a different number of strips per housing, e.g. by implementing two cases having a common back wall, each case containing, in parallel, a respective strip equipped with its connection parts. It is also possible to connect the elements making up the electrical circuit directly to a strip configured according to the invention in addition to the above-mentioned connection parts, and optionally also with other connection parts.

What is claimed is:

1. A connection facility for conductive wires, the connection facility including at least one electrically conductive rigid link strip (3) and at least one wire-connection part (2);

said wire-connection part formed by a spring blade having a first end (20) and a second end (23);

said first end having a perforation (21) therein for receiving a wire to be connected between a wire-abutment edge (22) of the perforation and said second end;

said second end of the spring blade being looped back on itself so that when no wire is received in said perforation the second end is resiliently pressed against the wire-abutment edge and penetrates said perforation;

said electrically conductive rigid link strip including at least one link element (30) that is planar and edged by at least one support element (31) having a distal end; wherein said at least one support element is engaged with said wire-connection part by initially inserting said at least one support element through said perforation of said first end of said wire-connection part and during subsequent further insertion said distal end of said at least one support element is slid past said wire-connection part so as to press against a loop formed by said second end of said wire-connection part looped back on itself to provide support for said wire-connection part.

2. A connection facility according to claim 1, wherein said electrically conductive rigid link strip is provided with a plurality of support elements (31) which are disposed on a same side of the at least one link element (30) that interconnects said plurality of support elements.

3. A connection facility according to claim 1, wherein said at least one support element (31) is comprised of a rectangular section prong designed to co-operate with said perforation (21) in said wire-connection part so as to position said wire-connection part.

4. A connection facility according to claim 3, wherein said at least one support element (31) is connected to the at least one link element (30) via an abutment portion (32);

said abutment portion abutting said wire-connection part after said prong is positioned within the perforation (21) of said wire-connection part; and said link element guiding the insertion of said wire to be connected in the perforation.

5. A connection facility according to claim 1, wherein said link element (30) includes at least one support element (38) for connection between the link element and an external additional interconnection part (5) so as to provide interconnection with another connection facility, the interconnection part being connected by straddling the support element, thereby avoiding reduction of the dimensions of the link element where said interconnection part is connected.

6. A connection facility according to claim 5, wherein said interconnection part is connected in a zone of the strip which is external from the link element.

7. A connection facility for conductive wires according to claim 1 further comprising complementary first and second pieces (24, 34) which lock together as soon as said wire-connection part (2) is fully engaged with said at least one support element (31), said first piece being a spring finger situated on the wire-connection part and said second piece being situated on said at least one support element (31).

8. A terminal block type connection module comprising a housing (1) containing a connection facility for conductive wires, the connection facility including at least one electrically conductive rigid link strip (3) and at least one wire-connection part (2);

said wire-connection part formed by a spring blade having a first end (20) and a second end (23);

said first end having a perforation (21) therein for receiving a wire to be connected between a wire-abutment edge (22) of the perforation and said second end;

said second end of the spring blade being looped back on itself so that when no wire is received in said perforation the second end is resiliently pressed against the wire-abutment edge and penetrates said perforation;

said electrically conductive rigid link strip including at least one link element (30) that is planar and edged by at least one support element (31) having a distal end; wherein said at least one support element is engaged with said wire-connection part by initially inserting said at least one support element through said perforation of said first end of said wire-connection part and during subsequent further insertion said distal end of said at least one support element is slid past said wire-connection part so as to press against a loop formed by said second end of said wire-connection part looped back on itself to provide support for said wire-connection part.

9. A connection module according to claim 8, wherein said electrically conductive rigid link strip (3) is held stationary via at least one of a central device (35) of said link strip and support elements (31) of a periphery of said link strip against at least one internal complementary bearing zone (12, 11) of the housing (1) containing the link strip; whereby, said planar link element (30) of the strip is positioned parallel to a large face (102) of the housing.

10. A connection module according to claim 9 wherein said planar link element (30) positioned parallel to the large face (102) of the housing forms the back of the housing and is flush with an opening designed to be closed by an external element that would form a partition parallel to the back of the housing.

11. A connection module according to claim 8 wherein said support elements (31) are disposed in parallel to the large back face of the housing.

12. A connection facility for conductive wires according to claim 8 further comprising complementary first and second pieces (24, 34) which lock together as soon as said wire-connection part (2) is fully engaged with said at least one support element (31), said first piece being a spring finger situated on the wire-connection part and said second piece being situated on said at least one support element (31).

* * * * *